US010392795B2

(12) United States Patent
Tsai

(10) Patent No.: US 10,392,795 B2
(45) Date of Patent: Aug. 27, 2019

(54) MODULAR CONTAINER BUILDING

(71) Applicant: Chao-Lung Tsai, Kaohsiung (TW)

(72) Inventor: Chao-Lung Tsai, Kaohsiung (TW)

( * ) Notice: Subject to any disclaimer, the term of this patent is extended or adjusted under 35 U.S.C. 154(b) by 0 days.

(21) Appl. No.: 15/743,026

(22) PCT Filed: Feb. 2, 2016

(86) PCT No.: PCT/CN2016/074561
§ 371 (c)(1),
(2) Date: Jan. 9, 2018

(87) PCT Pub. No.: WO2017/020583
PCT Pub. Date: Feb. 9, 2017

(65) Prior Publication Data

US 2018/0230691 A1 Aug. 16, 2018

(30) Foreign Application Priority Data

Aug. 6, 2015 (CN) ..... 2015 2 0583580 U

(51) Int. Cl.

| | |
|---|---|
| ***E04H 1/04*** | (2006.01) |
| ***E04B 1/343*** | (2006.01) |
| ***E04B 1/348*** | (2006.01) |
| *E04B 1/04* | (2006.01) |

(52) U.S. Cl.
CPC ..... *E04B 1/34331* (2013.01); *E04B 1/343* (2013.01); *E04B 1/348* (2013.01); *E04B 1/34823* (2013.01); *E04B 1/34861* (2013.01); *E04B 1/04* (2013.01)

(58) Field of Classification Search
CPC ... E04H 1/04; E04H 1/005; E04H 2001/1283; E04B 1/34807; E04B 1/3483; E04B 1/3442
See application file for complete search history.

(56) References Cited

U.S. PATENT DOCUMENTS

| | | | | |
|---|---|---|---|---|
| 2,499,498 A * | 3/1950 | Hammond, Jr. .... | E04B 1/34807 52/67 |
| 3,623,296 A * | 11/1971 | Santoro ..... | E04B 1/34807 52/79.12 |
| 5,661,930 A * | 9/1997 | Porter ..... | E04B 1/344 220/1.5 |
| 6,772,563 B2 * | 8/2004 | Kuhn ..... | E04B 1/34305 220/1.5 |
| 6,959,515 B1 * | 11/2005 | Beighton ..... | E04B 1/3483 52/236.7 |

(Continued)

*Primary Examiner* — Brian E Glessner
*Assistant Examiner* — Daniel J Kenny
(74) *Attorney, Agent, or Firm* — Schmeiser, Olsen & Watts, LLP

(57) ABSTRACT

An architectural structure of a modular container house includes: a building body with plural floors each having at least one accommodating space with an external opening; at least one external access area longitudinally disposed at the building body, and each accommodating space being communicated with external access area; and plural container houses, respectively and movably disposed in the accommodating spaces through the openings, and at least one side board of each container house can be spread open and placed horizontally on a ground of each accommodating space, so that the interior of each container house is communicated with each respective accommodating space.

4 Claims, 7 Drawing Sheets

(56) References Cited

U.S. PATENT DOCUMENTS

| | | | | |
|---|---|---|---|---|
| 6,983,567 | B2 * | 1/2006 | Ciotti | E04B 1/3442 52/64 |
| 8,166,715 | B2 * | 5/2012 | De Azambuja | B60P 3/34 52/122.1 |
| 9,016,001 | B2 * | 4/2015 | Heger | E04B 1/34357 52/79.5 |
| 10,167,645 | B2 * | 1/2019 | Geiger | E04B 1/34807 |
| 2006/0101727 | A1 * | 5/2006 | Holgerson | A62C 99/0081 52/79.1 |
| 2016/0059105 | A1 * | 3/2016 | Scade Garcia | E04H 1/12 52/69 |

* cited by examiner

100

100

MODULAR CONTAINER BUILDING

BACKGROUND OF INVENTION

1. Field of the Invention

The present invention relates to an architectural structure, in particular to the architectural structure of a modular container house composed of a building body and plurality of container houses.

2. Description of the Related Art

Since a traditional container already comes with a frame structure, there are excessive containers in the world, and the price of houses is high, more and more people reconstruct the traditional container into a container house in a factory and then transport the container house to a base and use the container as a home, a beverage or snack stall car, a store, etc, so as to save cost and construction time. What is more, the container has the features of neat layout, easy-to-install and easy-to-remove, and excellent transportability, and several container houses may be stacked to form a home or office building.

Although the traditional container house provides tremendous convenience and advantages, it still has the following drawbacks when compared with traditional buildings: (1) The container houses cannot be stacked into more than eight floors, so that the height is limited; (2) Since the container house has good thermal conductivity, so that the interior of the container house is hot in summer and cold in winter, and such container house is not suitable for living; (3) The container house is unable to overcome the issues of quick rusting and noises; and (4) If the container houses are stacked, the stacked container houses are lack of earthquake resistance, and thus the container houses may be shaken or collapsed in an earthquake. Therefore, the main reason that the traditional container house is not suitable to be stacked for use resides on that the stacked container houses are unable to provide a safe and comfortable environment.

SUMMARY OF THE INVENTION

In view of the drawbacks of the prior art, the inventor of the present invention based on years of experience in the related industry to conduct extensive research and experiment, and finally designed and developed an architectural structure of a modular container house to overcome the drawbacks of the prior art.

Therefore, it is a primary objective of the present invention to overcome the aforementioned drawbacks of the prior art and give a safe and comfortable living environment by providing an architectural structure of a modular container house formed by a building body and a plurality of container houses disposed in the building body.

To achieve the aforementioned and other objectives, the present invention provides an architectural structure of a modular container house, comprising: a building body, with a plurality of floors, each having at least one accommodating space, and each accommodating space including at least one external opening; and at least one external access area, longitudinally disposed at the building body, and each accommodating space being communicated with the at least one external access area; thereby, at least one container house is movably disposed in each accommodating space through each respective opening, and at least one side board of each container house can be spread open and placed horizontally on a ground of each accommodating space, so that the interior of each container house is communicated with each respective accommodating space Wherein, each container house includes furniture, electric appliances, bathroom equipments and kitchen equipments therein, and all interior equipments and decorations are integrated, and the whole container house may be moved, so as to improve over the transportability of the traditional buildings.

In summation, the present invention has the following effects:

(1) After each container house is put into each accommodating space, each container house may be used as a home, a store, or a commercial office, so that the architectural structure of the present invention may be formed as a residential building, a department store or an office building.

(2) The building body with a protection effect can prevent each container house from a direct contact with external moisture, so as to prevent the quick rust of the container house caused by rain and overcome the poor soundproofing issue. Such design also prevent a direct sunlight on each container house to improve the bad situation of each container house being very hot in summer and very cold in winter and make the living environment more comfortable than the traditional container house.

(3) With the solid structure of the building body, more than eight floors can be built in the building body. Compared with the traditional container house, the height of the stacked container houses of the present invention is relatively greater. In addition, the invention has a better effect of preventing each container house from being shaken or collapsed in an earthquake, so as to improve the safety.

(4) Compared with the traditional residential building, department store or office building, the present invention provides a modular design for each container house and building body, so as to reduce the total construction cost and construction time of the architectural structure.

(5) Besides maintaining the advantages of environmental friendliness and high transportability of the traditional container house, the container house of the present invention comes with basic decoration, so that the present invention can save the secondary decoration cost incurred in a moving and due to personal habits and preferences.

In summation of the description above, the present invention integrates the traditional buildings and container house, while providing the same safety as the traditional buildings and the dexterity of the container house, and overcoming the drawbacks of the traditional houses.

DESCRIPTION OF THE INVENTION

Figure 1:
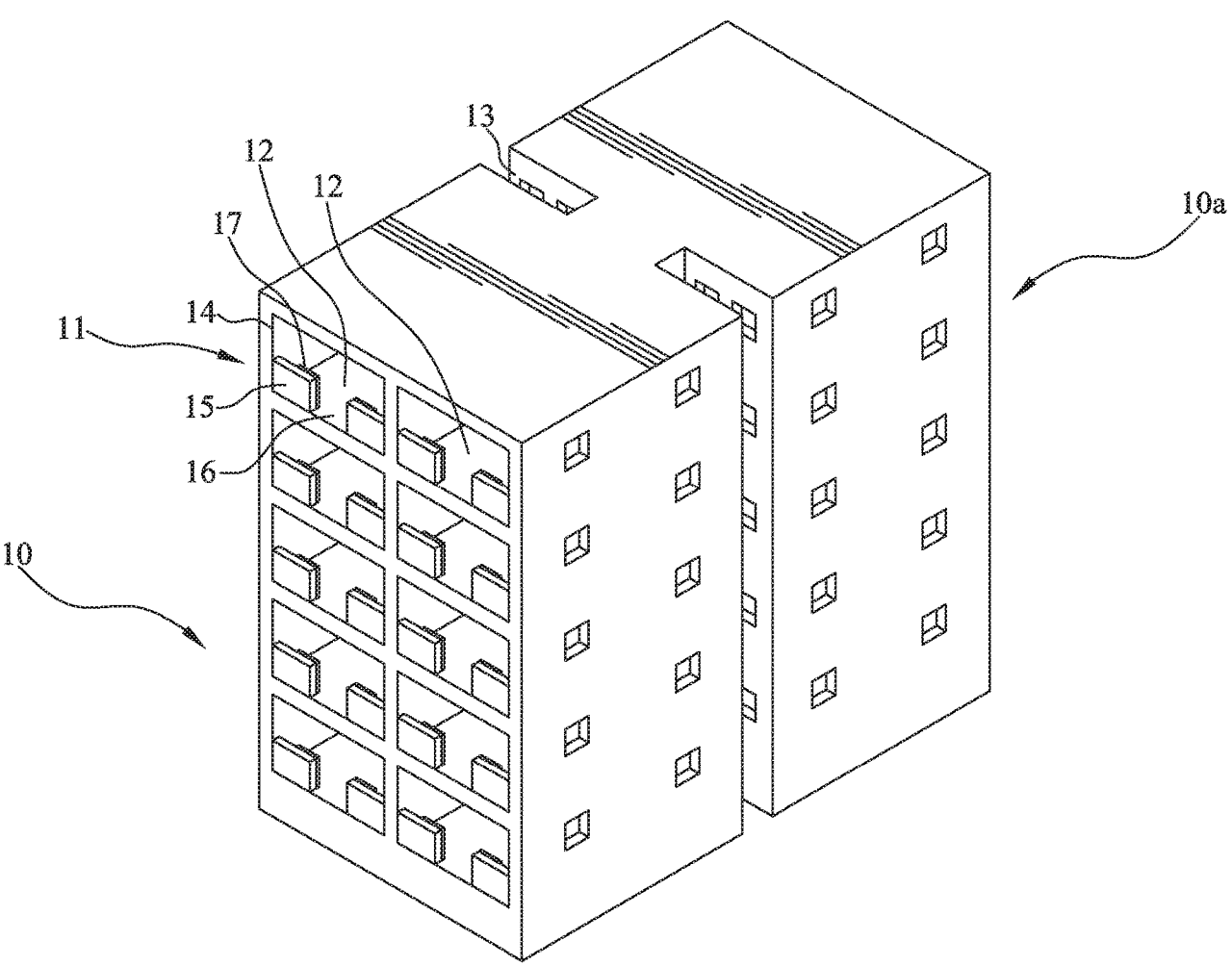
FIG. 1 is a perspective view of a building body of the present invention.

The above and other objects, features and advantages of this invention will become apparent from the following detailed description accompanied by the drawings. It is noteworthy that the embodiments are provided for the purpose of describing the main concept of the present invention, and each element mentioned in the embodiments is described according to suitable proportion, size, deformation, or displacement for simplicity, but not necessarily described or drawn according to the actual proportion of the elements. For example, the container house of this embodiment is not limited to those reconstructed from a container only, but any equivalent structure is covered by the scope of this invention.

With reference to FIGS. 1 to 4 for an architectural structure of a modular container house 100 in accordance with the present invention, the architectural structure comprises the following elements:

A building body 10 is made of a reinforced concrete building material, a solid green material or any other building material and has a plurality of floors capable of carrying heavy loads 11, and each floor 11 has at least one accommodating space 12. In each embodiment as shown in the drawings of the present invention, there are two accommodating spaces 12 on each floor 11 and these accommodating spaces 12 are arranged horizontally.

Each accommodating space 12 has an external opening 14 and a water/electricity/gas supply pipeline (not shown in the figure) buried into the building body 10 or separated from the building body 10. In addition, each opening 14 has a wall 15, and each wall 15 has a notch 16, and each wall 15 has a movable pull wall 17 disposed on an inner side of each notch 16 for covering each notch 16.

Figure 2:
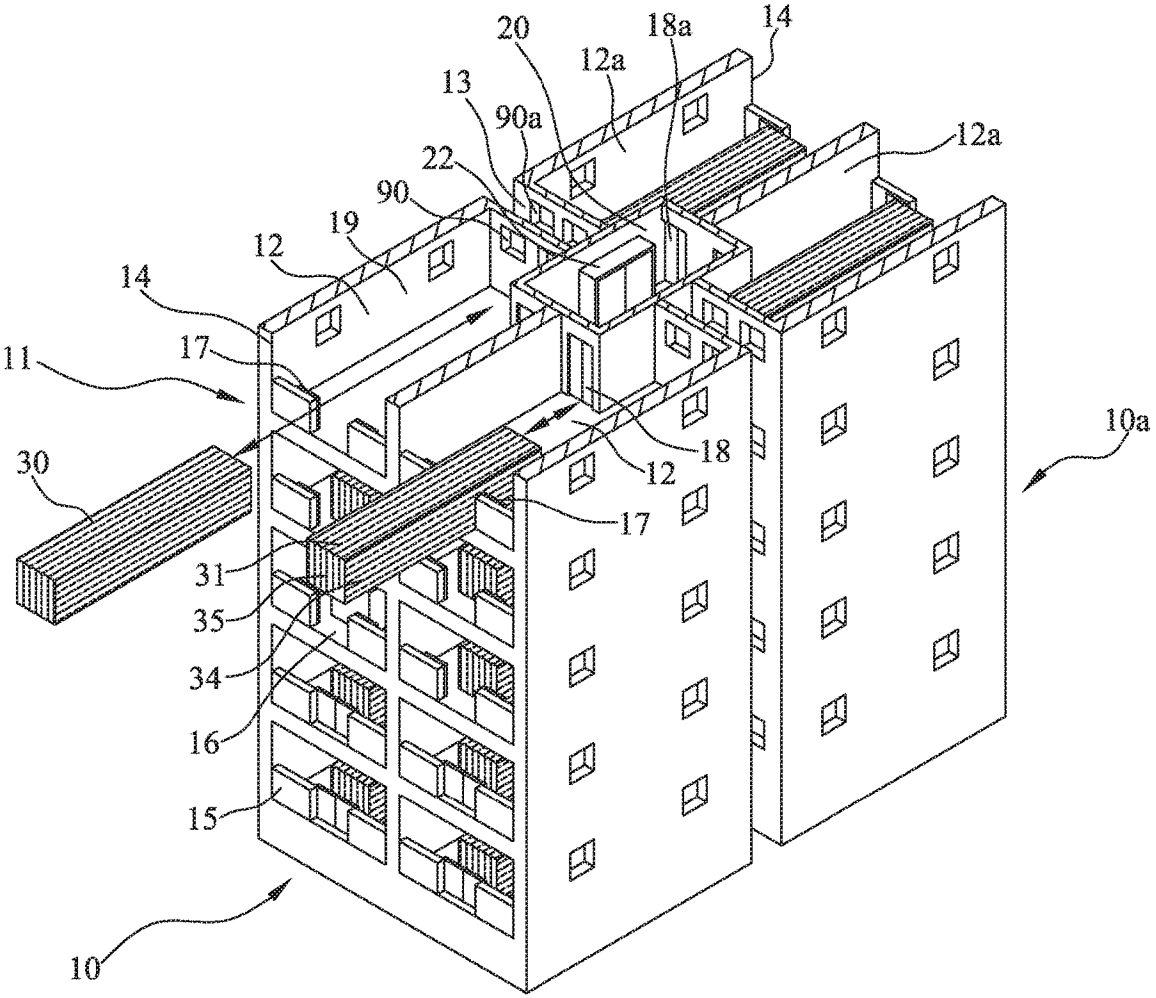
FIG. 2 is a schematic view of each container house disposed in each respective accommodating space in accordance with the present invention.
Figure 3:
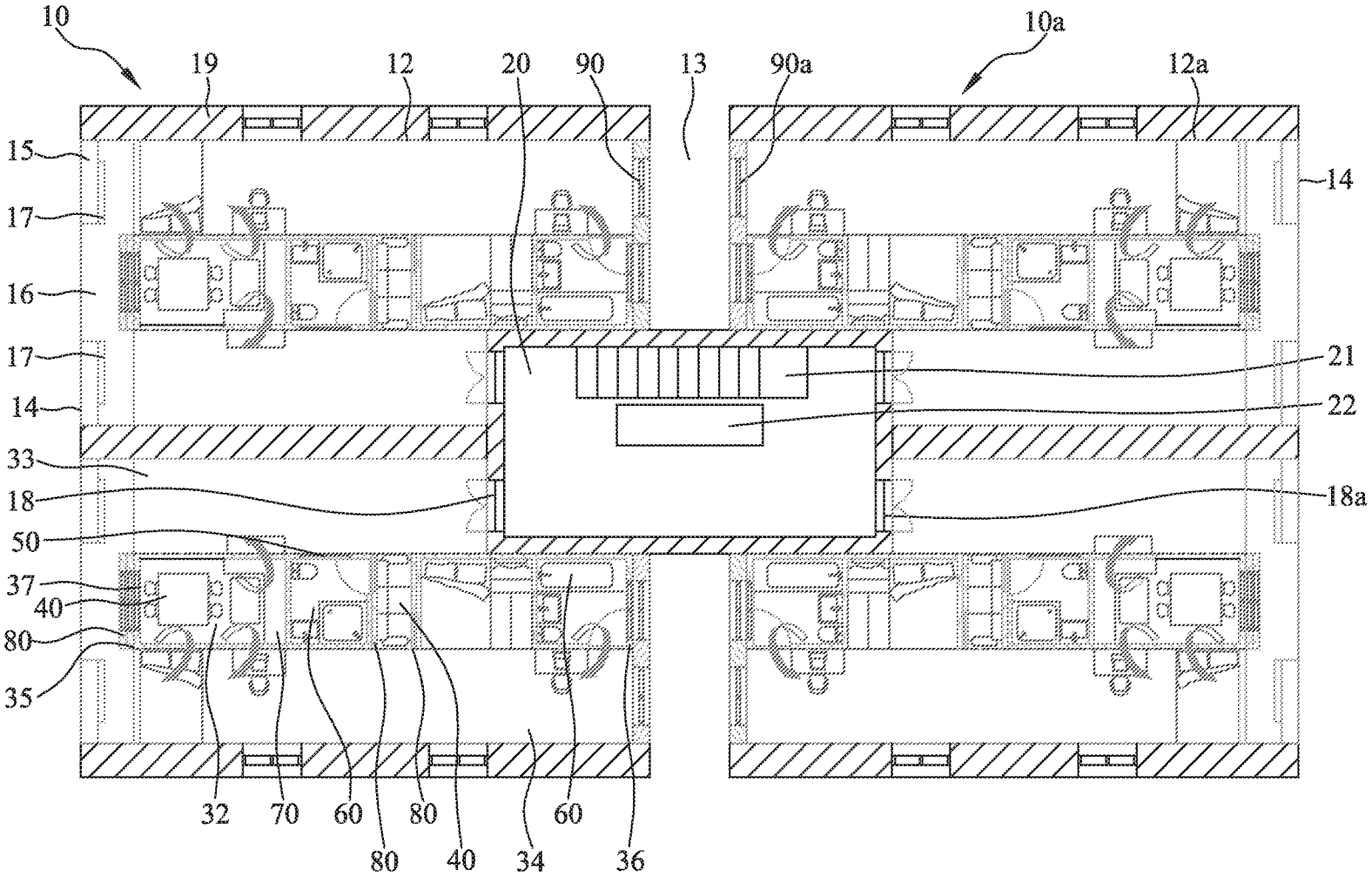
FIG. 3 is a first schematic view of a using status of the present invention, showing that a front board of each container house faces towards each opening, and each first side board has a spread-open area smaller than each second side board.

In addition, the architectural structure 100 in accordance with a preferred embodiment of the present invention has two building bodies 10, 10*a*, a spacing 13 formed between the two building bodies 10, 10*a*, and the openings 14 of the two building bodies 10, 10*a* are formed on opposite sides of the two building bodies 10, 10*a* respectively, so that the accommodating spaces 12, 12*a* are disposed symmetrically as shown in FIGS. 2 and 3, and the wall surfaces of each accommodating space 12, 12*a* facing towards the interior and the exterior of the spacing 13 have a plurality of windows 90, 90*a* formed thereon.

At least one external access area 20 is longitudinally disposed between the two building bodies 10, 10*a*, and a stair 21, an elevator 22 or a combination of both is installed. In the drawings of the present invention, there are two accommodating spaces 12, 12*a* on each floor 11 of the two building bodies 10, 10*a*, and there is one external access area 20 for example. The external access area 20 is disposed on the same side and between every two adjacent accommodating spaces 12, 12*a*, so that each accommodating space 12, 12*a* is communicated with the external access area 20 through an entrance/exit door 18, 18*a*.

A plurality of container houses 30 is movably disposed in each accommodating space 12, 12*a* one by one through the notch 16 of each opening 14. In the present invention, each container house 30 is moved from the ground and outside each accommodating space 12, 12*a* by a hoisting or electrically driven mechanical transport system, and then each container house 30 including a wheel (not shown in the figure) or a corresponsive track device (not shown in the figure) is transported into each accommodating space 12, 12*a* by means of a rail (not shown in the figure). After the container house 30 is entered into each accommodating space 12, 12*a*, a fixing means may be used to fix each container house 30, and the fixing means may be a mechanical land-locked tile or any conventional mechanical fixing means. The transport may be conduct by traditional hoisting. In addition, the containing house 30 may be entered from a side of the architectural structure 100, and its combination method is not restricted to any particular method.

Each container house 30 is substantially in a rectangular shape and has a top board 31 and a bottom board 32 parallel to each other, a first side board 33 and a second side board 34 parallel to each other, and a front board 35 and a rear side board 36 parallel to each other, wherein the width of the first side board 33 and the second side board 34 is greater than the front board 35 and the rear side board 36, and the first side board 33 and second side board 34 may be spread open with respect to the container house 30 and horizontally disposed on a ground of each accommodating space 12, 12*a* as shown in FIG. 3, so that the interior of each container house 30 is communicated with each accommodating space 12, 12*a*.

Figure 4:
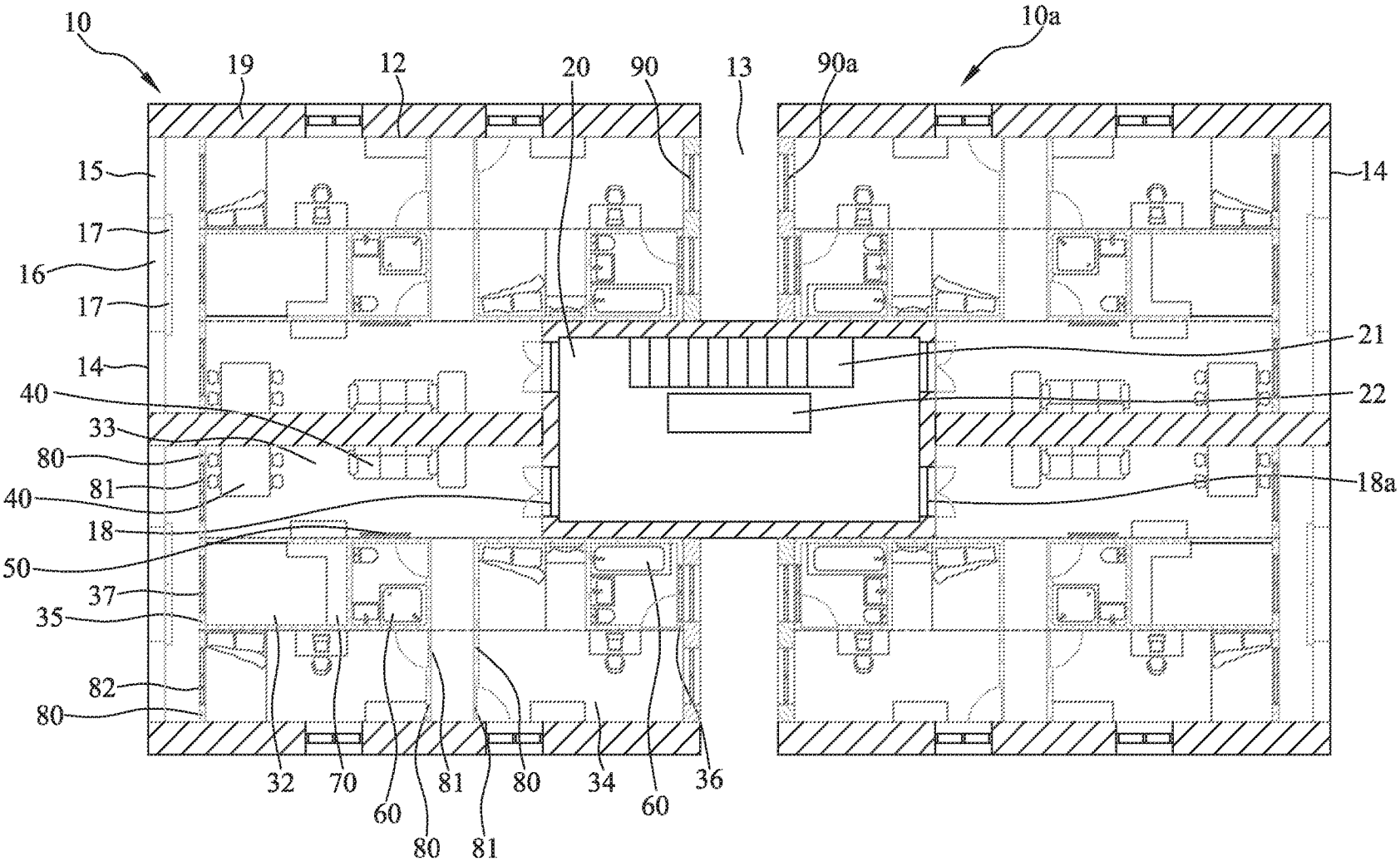
FIG. 4 is a second schematic view of a using status of the present invention, showing that each piece of furniture and each electric appliance are moved to the required positions, and each movable partition is used for partition, and each pull wall covers each respective notch.

In the first embodiment of the present invention, each accommodating space 12, 12*a* has a side wall 19 with a width greater than the opening 14, so that each container house 30 may be entered from a narrower side (which is the front board 35 or the rear side board 36) into each accommodating space 12, 12*a*, and when each container house 30 is put into each accommodating space 12, 12*a*, each front board 35 faces towards each respective opening 14, and each front board 35 has a door 37, and each rear side board 36 faces towards the spacing 13 as shown in FIGS. 3 and 4, and each first side board 33 has a spread-open area smaller than each second side board 34. After the spreading, the short side of each first side board 33 faces towards each entrance/exit door 18, 18*a*.

In addition, a spacing is formed between each container house 30 and each opening 14, so that after each container house 30 is disposed in each respective accommodating space 12, 12*a*, each pull wall 17 covers each respective notch 16 and encloses a balcony space.

In addition, each container house 30 has a water/electricity/gas equipment (not shown in the figure) installed therein and connected to a water/electricity/gas supply pipeline of each accommodating space 12, 12*a* and a plural pieces of furniture 40 (such as a bed, table and chair, a cabinet, etc), a plurality of electric appliances 50 (such as a television, lamp, etc) connected to each water/electricity/gas equipment, at least one bathroom equipment 60 and a kitchen equipment 70, and the at least one bathroom equipment 60 and the kitchen equipment 70 are disposed at relative position of the bottom board 32, and each accommodating space 12, 12*a* may have an air conditioning equipment (not shown in the figure) installed at the relative positions of the first side board 33 and the second side board 34 respectively.

In addition, each container house 30 has a plurality of movable partitions 80, and each movable partition 80 has a door 81 or a window 82, so that after the first side board 33 and the second side board 34 are spread open, each furniture 40 and each electric appliance 50 are moved to the desired positions, and each movable partition 80 is fixed for partitioning the balcony space, and then the spread container house 30 is designed with a layout having two bedrooms, two dining rooms, and two bathrooms as shown in FIG. 4.

Each container house 30 is put into each respective accommodating space 12, 12*a*, and then the first side board 33 and the second side board 34 are spread open, and each piece of furniture 40 and each electric appliance 50 are moved to the desired positions respectively, and each movable partition 80 is fixed. After the water/electricity/gas equipment of each container house 30 is connected to the water/electricity/gas supply pipeline of the building body 10, each container house 30 may be used as a home, a store or a commercial office, and the architectural structure 100 of the present invention may be formed into a residential building, a department store or an office building.

With the building body 10, the present invention can prevent each container house 30 from a direct contact with external moisture, so as to prevent each container house 30 from being rusted by rain quickly and overcome the poor soundproof issue. In addition, the invention can prevent a direct sunlight to each container house 30 to improve the issue of having hot summer and cold winter in each container house 30. With the solid structure of the building body 10, more than eight floors 11 can be built in the building body 10. Compared with the traditional container house, the overall stacked height of the container houses 30 is not restricted in the present invention, and the invention has the effect of preventing each container house 30 from being shaken or collapsed during an earthquake. Therefore, the building body 10 has the effect of protecting each container house 30.

Compared with the architecture of the traditional residential building, department store or office building, the present invention provides a modular design of each container house 30 and each building body 10, 10*a*, so as to reduce the total construction cost and time of the architectural structure 100. Besides maintaining the advantages of environmental friendliness and high transportability of the traditional container house 30, the container house 30 of the present invention comes with basic decoration, so that the present invention can save the secondary decoration cost incurred in a moving and due to personal habits and preferences.

Figure 5:
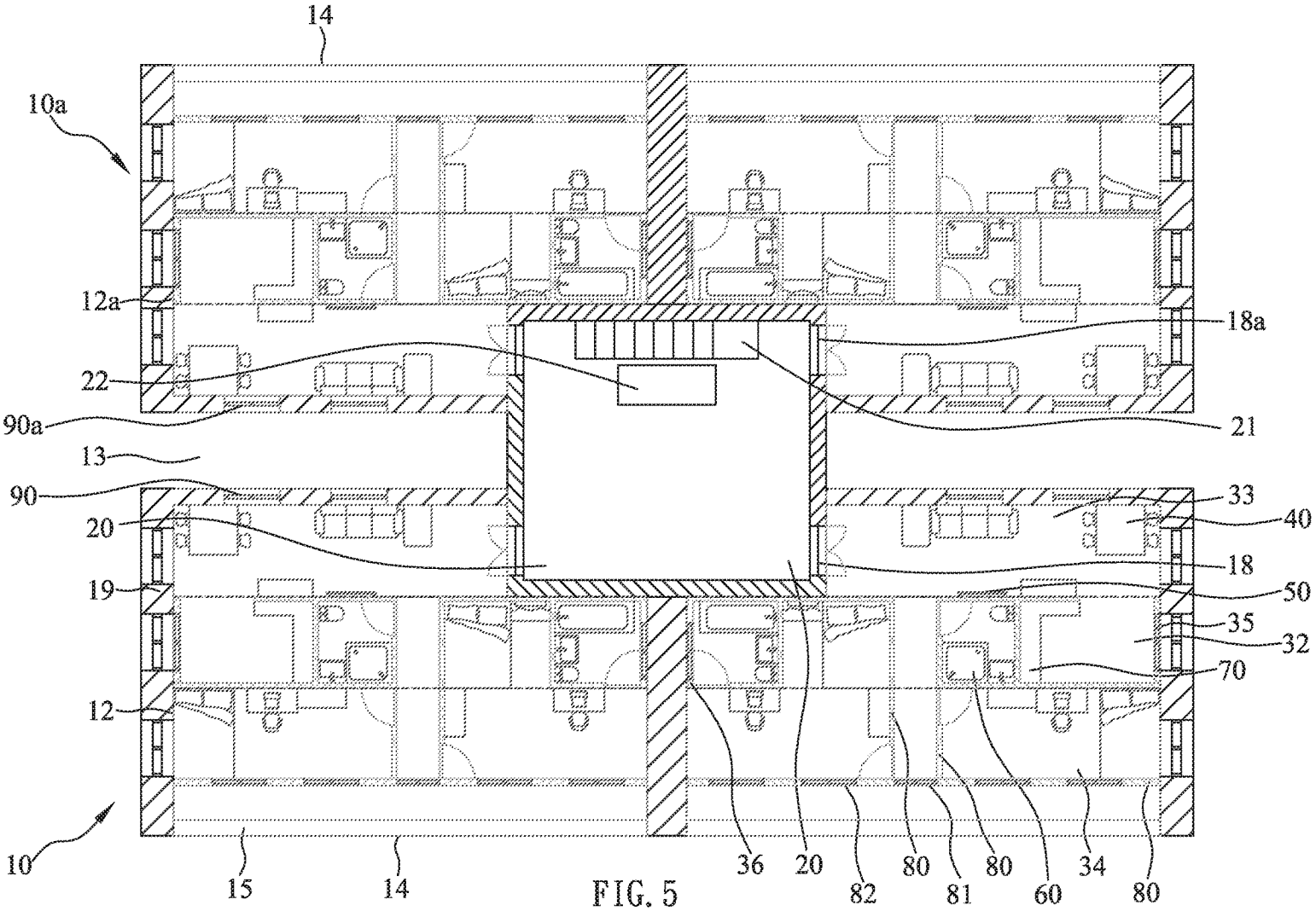
FIG. 5 is a schematic view of a second embodiment of the present invention, showing that a second side board of each container house faces towards each respective opening, and each first side board has a spread-open area smaller than each second side board.

With reference to FIG. 5 for the second embodiment of the present invention, the difference between this embodiment and the first embodiment resides on that the side wall 19 of each accommodating space 12, 12*a* of this embodiment has a width smaller than the opening 14, so that each container house 30 may be entered from a wider side (which is the first side board 33 or the second side board 34) into each accommodating space 12, 12*a*. When each container house 30 is disposed in each accommodating space 12, 12*a*, each first side board 33 and each second side board 34 face the spacing 13 and each opening 14 respectively, and each first side board 33 has a spread-open area smaller than each second side board 34. After each first side board 33 is spread open, the short side of each first side board 33 faces towards each entrance/exit door 18, 18*a*, and the long side of each first side board 33 faces towards the spacing 13.

In this embodiment, each wall 15 may be disposed on the ground of each accommodating space 12, 12*a*. After each container house 30 is put into each respective accommodating space 12, 12*a*, the container house 30 is turned over and fixed, and the movable partition 80 for partitioning the balcony space may be placed on each second side board 34. After each second side board 34 is spread open, the movable partition 80 is spread open.

Figure 6:
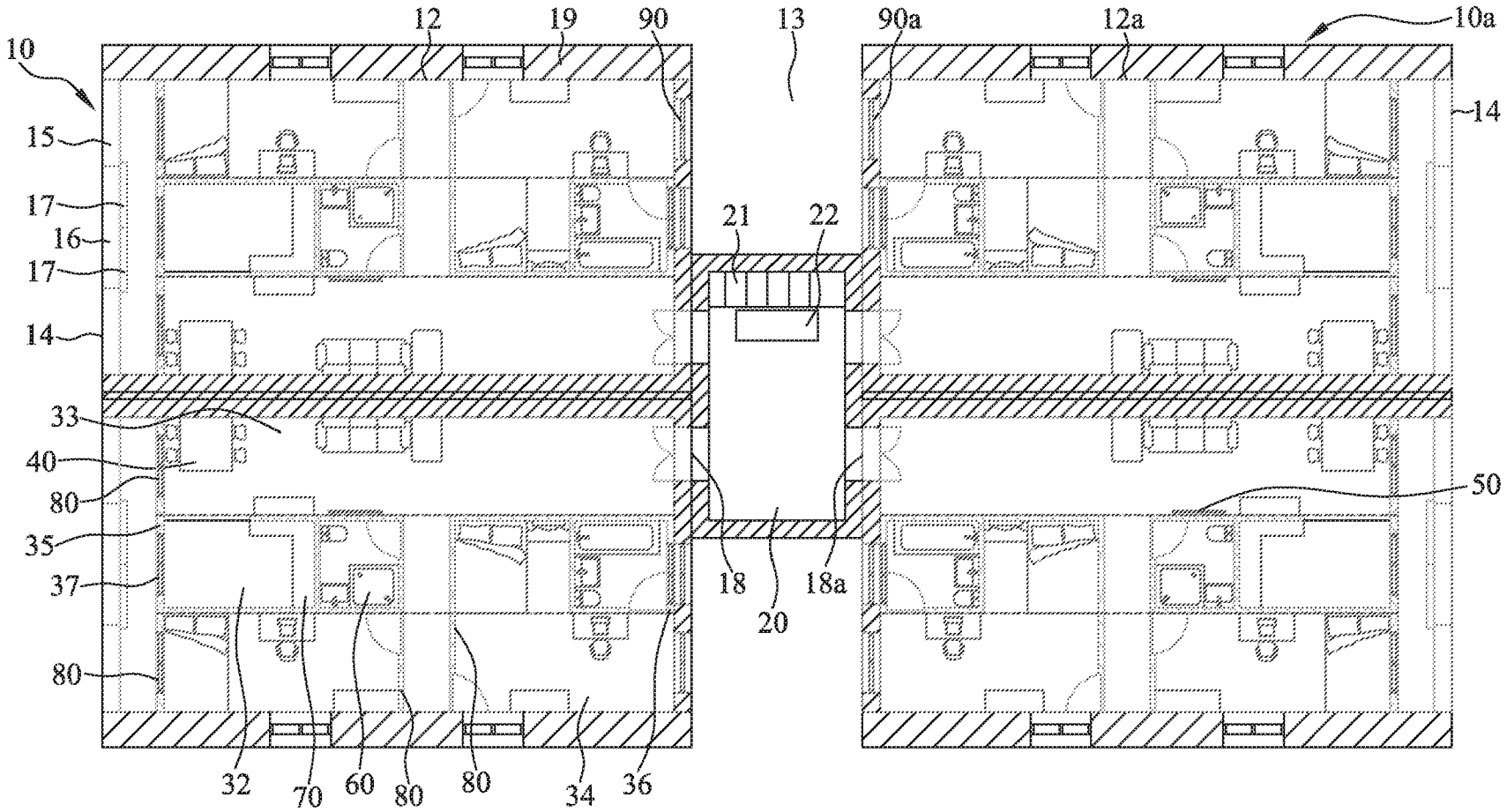
FIG. 6 is a schematic view of a third embodiment of the present invention, showing that a front board of each container house faces towards each respective opening, and each first side board has a spread-open area equal to each second side board.

With reference to FIG. 6 for the third embodiment of the present invention, the difference between this embodiment and the first embodiment resides on that each first side board 33 has a spread-open area equal to each second side board 34.

Figure 7:
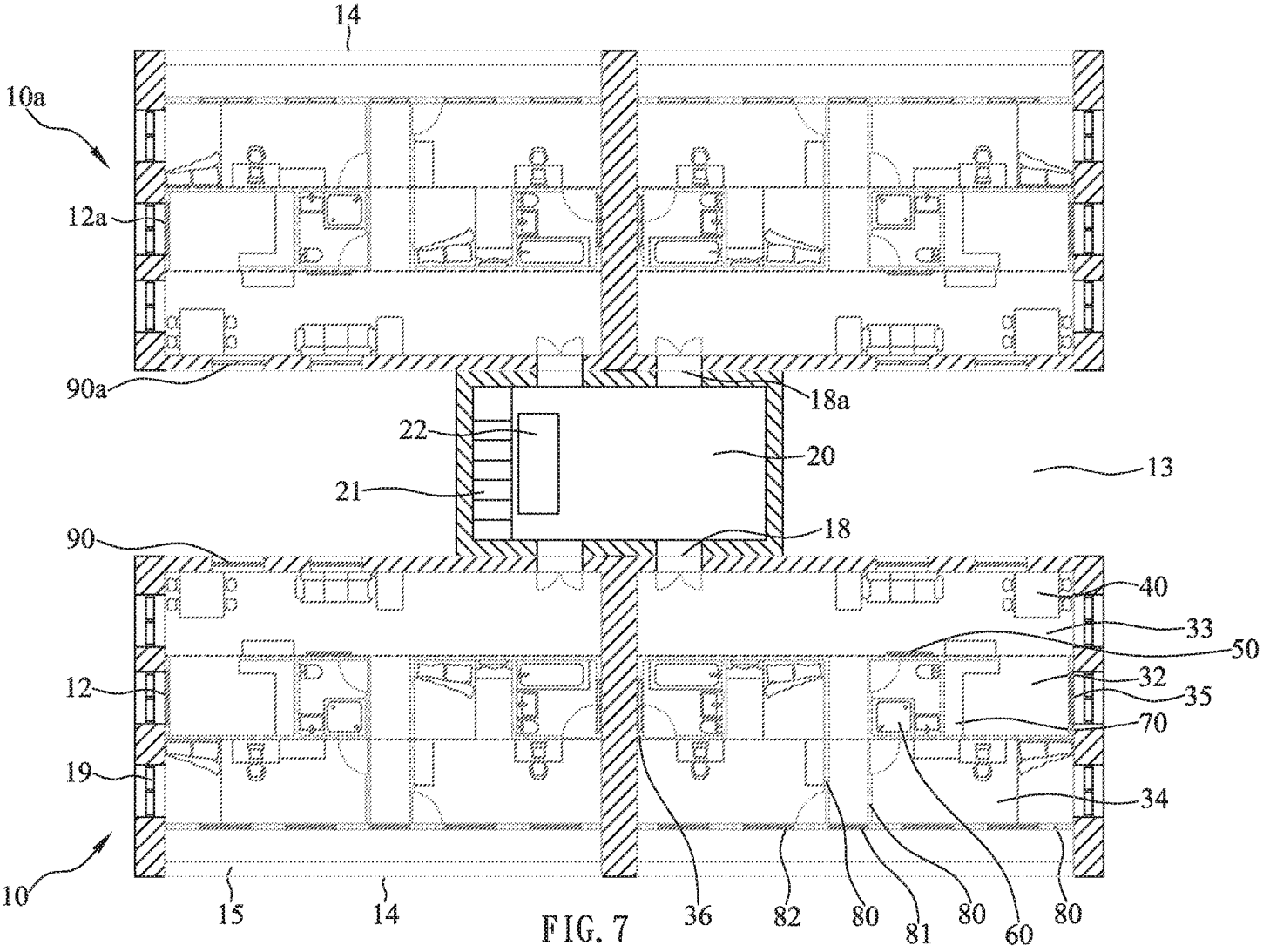
FIG. 7 is a schematic view of a fourth embodiment of the present invention, showing that a second side board of each container house faces towards each respective opening, and each first side board has a spread-open area equal to each second side board.

With reference to FIG. 7 for the fourth embodiment of the present invention, the difference between this embodiment and the second embodiment resides on that each first side board 33 has a spread-open area equal to each second side board 34, and after each first side board 33 is spread open, the long side of each first side board 33 faces towards each entrance/exit door 18, 18*a* and towards the spacing 13.

In summation of the description above, the present invention may change the quantity of accommodating spaces 12, 12*a* of each floor 11 as needed, so that each floor 11 may have one, two, four, or many households. In addition, the spread-open area of the first side board 33 may be adjusted to be smaller than or equal to each second side board 34, and each container house 30 may be entered/removed from a narrower side (which is the front board 35 or the rear side board 36) or a wider side (which is a first side board 33 or a second side board 34) into/from the accommodating space 12, 12*a*, or each movable partition 80 and side wall 19 may be designed with any combination of windows 82, 90, 90*a* and doors 81 according to the required layout, so as to provide a more diversified architectural structure 100. Regardless of any quantity, size, and material of the container houses, any equivalent application of the spatial layout is covered by the scope of the present invention.

While the invention has been described by means of specific embodiments, numerous modifications and variations could be made thereto by those skilled in the art without departing from the scope and spirit of the invention set forth in the claims.

What is claimed is:

1. A modular container building, comprising:

a building body, with a plurality of floors, each floor having at least one accommodating space with at least one external opening, wherein each external opening has a wall with a notch therein through which a container house may be inserted into the accommodating space and a pull wall disposed on an inner side of each notch for covering the notch after the container house has been inserted through the notch;

at least one external access area, disposed within the building body, each accommodating space being in communication with the at least one external access area; and at least one container house of substantially cuboid shape, each container house further comprising:

a horizontal roof;

a bottom board parallel to the roof;

a first side board;

a second side board, wherein the second side board is parallel to the first side board while both the first side board and the second side board are in a closed vertical configuration;

a vertical front board; and a rear board parallel to the front board, wherein each of the first side board and the second side board has a width greater than that of the front board and the rear board respectively, and both the first side board and the second side board are configured to be transitioned between a closed vertical configuration and a spread open configuration, wherein each first side board is disposed on the same side of the bottom board of the container house as each respective entrance/exit door, wherein each of the at least one container house is movably disposed within each accommodating space, respectively, such that a spacing is disposed between each container house and each respective external opening, wherein at least one side board of each container house is configured to be transitioned between a closed vertical configuration and a spread open configuration, wherein in the spread open configuration the at least one side board is spread open and placed horizontally on a ground of each accommodating space, such that the interior of each container house is in communication with each respective accommodating space, respectively.

2. The modular container building of claim 1, wherein the at least one external access area is disposed between every two adjacent accommodating spaces of each floor and each accommodating space is in communication with the at least one external access area through an entrance/exit door, the modular container building further comprising:

a rail installed in each accommodating space;

a means installed in each accommodating space for fixing each container house to an accommodating space, respectively; and a transport system installed on the building body.

3. The modular container building of claim 1, wherein each container house has a plurality of movable partitions, each movable partition having at least one of a door and a window.

4. The modular container building of claim 3, wherein each first side board has a spread-open area equal to or smaller than each second side board and each second side board is disposed on the same side of the bottom board of the container house as each respective external opening.

* * * * *